United States Patent [19]

Sato et al.

[11] Patent Number: 4,715,657

[45] Date of Patent: Dec. 29, 1987

[54] DOUBLE RANGING DRUM CUTTER HAVING BEDROCK SENSOR BASED ON VIDEO IMAGE PROCESSING SYSTEM

[75] Inventors: Koji Sato, Chiba; Hiroshi Kuroda, Omuta; Ryuji Yamada, Omuta; Mamoru Serino, Omuta, all of Japan

[73] Assignees: Zaidan Hojin Sekitan Gijutsu Kenkyusho; Mitsui Sekitan Kogyo Kabushiki Kaisha; Kabushiki Kaisha Mitsui Miike Seisakusho, all of Tokyo, Japan

[21] Appl. No.: 900,419

[22] Filed: Aug. 26, 1986

Related U.S. Application Data

[63] Continuation-in-part of Ser. No. 703,267, Feb. 20, 1985, abandoned.

[30] Foreign Application Priority Data

Feb. 23, 1984 [JP] Japan ..... 59-31470

[51] Int. Cl.[4] ..... E21C 35/08

[52] U.S. Cl. ..... 299/1; 299/43

[58] Field of Search ..... 299/1, 42, 43

[56] References Cited

U.S. PATENT DOCUMENTS

| | | | |
|---|---|---|---|
| 3,876,251 | 4/1975 | Boyd et al. | 299/1 |
| 4,143,552 | 3/1979 | Godfrey | 299/1 X |
| 4,262,964 | 4/1981 | Ingle et al. | 299/1 |
| 4,279,443 | 7/1981 | Talcahashi et al. | 299/1 |
| 4,281,876 | 8/1981 | Lansberry | 299/1 |
| 4,513,504 | 4/1985 | Nussbaumer et al. | 299/1 X |

FOREIGN PATENT DOCUMENTS

| | | | |
|---|---|---|---|
| 2332169 | 1/1975 | Fed. Rep. of Germany | 299/1 |
| 2714357 | 11/1977 | Fed. Rep. of Germany | 299/1 |
| 2644665 | 4/1978 | Fed. Rep. of Germany | 299/1 |
| 2044032 | 10/1980 | United Kingdom | 299/1 |
| 911030 | 3/1982 | U.S.S.R. | 299/1 |

*Primary Examiner*—Stephen J. Novosad

*Attorney, Agent, or Firm*—George B. Oujevolk

[57] ABSTRACT

A double ranging drum cutter for long wall type machines for coal extraction is disclosed, which comprises a drum cutter body, a television camera mounted on the drum cutter body for picking up an image of a coal layer cutting portion of a lower bedrock being cut by a cutter drum, a television camera mounted on the drum cutter body for picking up an image of a coal layer cutting portion of an upper bedrock being cut by a cutter drum, and a video image processing unit mounted on the drum cutter body and connected to the television cameras, whereby the boundary between a coal layer and bedrock can be readily judged to permit extraction of much coal without cutting much bedrock and also the ratio of the area of a bedrock to the area of a coal layer in a portion of the bedrock being cut can be readily detected.

1 Claim, 7 Drawing Figures

DOUBLE RANGING DRUM CUTTER HAVING BEDROCK SENSOR BASED ON VIDEO IMAGE PROCESSING SYSTEM

This application is a continuation-in-part of application Ser. No. 703,267 filed Feb. 20, 1975, now abandoned.

BACKGROUND OF THE INVENTION

1. Field of the Invention

This invention relates to a double ranging drum cutter having a bedrock sensor based on a video image processing system and, more particularly, to a double ranging drum cutter of long wall type for coal extraction in which the boundary between a coal layer and bedrock over or under the coal layer can be readily judged in an atmosphere containing a great quantity of mine dust, therby permitting the cutting of a large quantity coal layer without cutting much bedrock.

2. Description of the Prior Art

Present day coal mines make use of a double ranging drum cutter that is used for long wall type coal extraction. This machine includes a drum cutter body which is moved along a coal layer under the guide of a face conveyor, a drum support arm rotatably mounted by a transversal shaft on each end of the drum cutter body in the direction of movement thereof, an arm driver for rotating each of the arms, and a cutter drum mounted on the end of each arm and driven by a drum driver.

When the double ranging drum cutter is operated for long wall type coal extraction, the operator judges whether the cutter drum is cutting a coal layer of the bedrock from vibrations of the drum cutter body, sparks, noise or the like produced as the cutter drum is cutting the bedrock in contact therewith.

However, it is difficult to make an accurate determination in an atmosphere containing a great quantity of floating mine dust as to whether a boundary between a coal layer and bedrock is being cut with the man's five senses. Also, it is difficult to have quantitative knowledge of the ratio of the area of a bedrock to the area of a coal layer in a portion of the bedrock being cut.

If the area of the bedrock in a portion of the bedrock being cut is excessive, early wear of the pick in the cutter drum results because the bedrock is hard. On the other hand, if no bedrock is cut at all, a comparatively great quantity of coal will remain unextracted adjacent to the bedrock, so that the coal extraction efficiency is low.

OBJECTS OF THE INVENTION

A first object of the present invention is to provide a double ranging drum cutter of long wall type for coal extraction comprising a drum cutter body, a television camera mounted on the drum cutter body for picking up an image of a coal layer cutting portion of a lower bedrock being cut by a cutter drum, a television camera mounted on the drum cutter body for picking up an image of a coal layer cutting portion of an upper bedrock being cut by a cutter drum, and a video image processing unit mounted on the drum cutter body and connected to the television cameras, whereby a boundary between a coal layer and bedrock can be readily judged to permit extraction of much coal.

A second object of the present invention is to permit the ready determination of the area ratio between a coal layer and bedrock in a portion of the bedrock being cut.

A third object of the present invention is to improve the performance of picking up an image of the portion of the bedrock being cut by projecting an infrared ray onto the portion with an infrared ray television camera.

A fourth object of the present invention is to permit automatic control of the ratio of the area of a bedrock to the area of a coal layer in a portion of the bedrock being cut to a smaller value through feedback control of a drum support arm according to the output signal of a video image processing unit.

BRIEF DESCRIPTION OF THE DRAWINGS

FIGS. 4A and 4B are flow charts of the control system wherein FIG. 4A represents the top of the chart and FIG. 4B the bottom of the chart.

DETAILED DESCRIPTION OF THE PREFERRED EMBODIMENT

Figure 1:
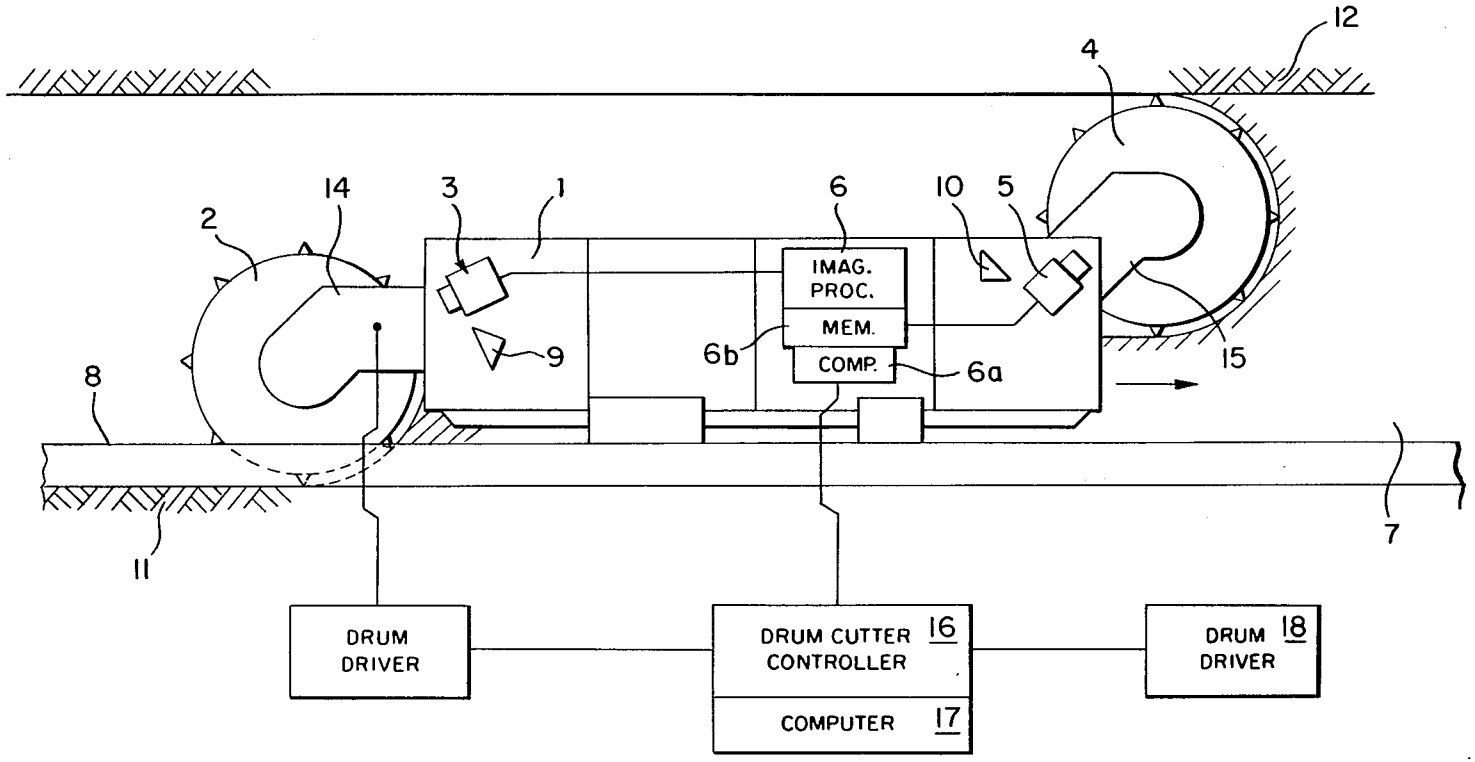
FIG. 1 is a side view showing a double ranging drum cutter having a bedrock sensor based on a video image processing system according to the present invention.

FIG. 1 shows a double ranging drum cutter of long wall type for coal extraction having a bedrock sensor based on a video image processing system according to the present invention. A face conveyor 8 is installed on a lower bedrock 11 such that it extends in the longitudinal direction toward the front of a coal layer 7. A drum dutter body 1 is mounted on the face conveyor 8 and moved in the longitudinal direction along the face conveyor 8. A stem of a drum support arm 14 is rotatably mounted by a transversal shaft on the front end of the drum cutter body 1. The drum support arm 14 can be turned in vertical directions by an arm driver provided on the drum cutter body 1.

A rear or left cutter drum 2 is mounted on the end of the left drum support arm 14 and is driven by a drum driver. A television camera 3 for picking up an image of a portion of the lower bedrock being cut by the left cutter drum 2 and an infrared ray projector 9 for projecting infrared rays onto an image pick-up section of the television camera are mounted on the left side of the drum cutter body 1.

A stem of a drum support arm 15 is rotatably mounted by a transversal shaft on the right side of the drum cutter body 1. The right drum support arm 15 is rotated in vertical directions by an arm driver provided on the drum cutter body 1.

A front or right cutter drum 4 is mounted on the end of the right drum support arm 15 and driven by a drum driver. A television camera 5 for picking up an image of a portion of a upper bedrock being cut by the right cutter drum 4 and an infrared ray projector 10 for projecting infrared rays onto an image pick-up section of the television camera are mounted on the right side of the drum cutter body 1. The television cameras 3 and 5 are connected to a video image processing unit 6 mounted on the drum cutter body 1.

A portion of the lower bedrock 11 in the neighborhood of the top surface thereof being cut by the left cutter drum 2 is televised by the television camera 3, while a portion of the upper bedrock 12 in the neighborhood of the surface thereof being cut by the left cutter drum 4 is televised by the television camera 5. Video signals from the television cameras are fed to the video image processing unit 6, and the area ratio between the bedrock and coal layer being televised is determined by making use of the difference in color. The ratio of the area of the bedrock to the area of the coal layer in the portion of the bedrock being cut is obtained as a physical quantity from the video image processing unit 6.

Figure 2:
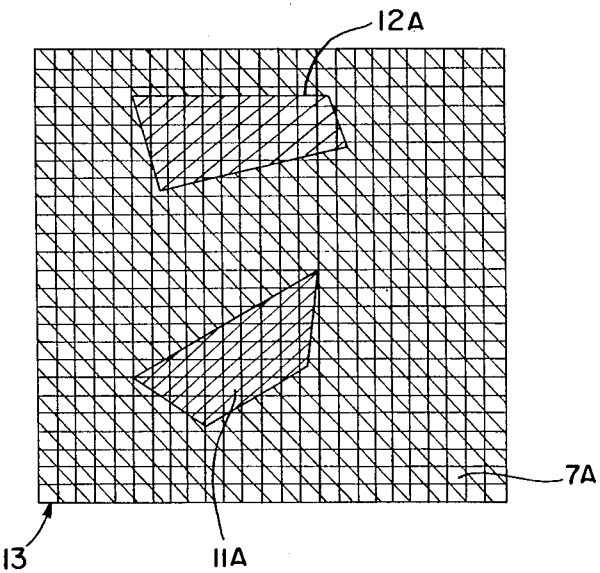
FIG. 2 is a view showing an embodiment of an input display for a video image processing unit.

FIG. 2 shows a display 13 obtained with the television camera. The displayed image is processed as finely divided data by the video image processing unit 6, and the area ratio between a coal layer image 7A and bedrock image 11A is calculated from the difference of colors on the display. The data obtained as a result of calculation is fed from the video image processing unit 6 to a cutting status supervision display unit for display thereon.

The drum support arms 14 and 15 are feedback controlled according to the output signal of the video image processing unit 6. In this way, the ratio of the area of the bedrock to the area of the coal layer in a portion of the bedrock being cut is automatically controlled to a smaller value.

In the display 13 shown in FIG. 2, portions other than the image 11A of rock show an image 7A of coal. The area ratio B/C of the total area B of the image area 11A showing rock to the total area C of the image area 7A of coal is calculated. When the area ratio B/C on the side of the left side cutter drum 2 is increased, the drum support arm 14 is turned upwardly to reduce the area ratio B/C. When the area ratio B/C on the side of the right side cutter drum 4 is increased, the drum support arm 15 is turned downwardly to reduce the area ratio B/C.

Infrared rays, to which dust is satisfactorily permeable, are projected from the infrared ray projectors 9 and 10 onto the cutting surface produced on the bedrock by the cutter drums 2 and 4, and the cutting surface irradiated by the infrared rays photographed by the infrared ray television cameras 3 and 5. It is thus possible to pick up clear images of coal and rock in the cutting surface formed on the bedrock and readily grasp the areas of the cutting surface occupied by coal and rock, respectively.

Further, since the boundary between the coal layer and the bedrock has irregularities, it is possible to reduce the amount of coal remaining without being extracted and improve the coal extraction efficiency by driving the cutter drums such as to cut part of bedrock together with coal. Also since the cutter drums can be driven substantially straight at all time, the operation of the cutter drums can be readily controlled.

Figure 3:
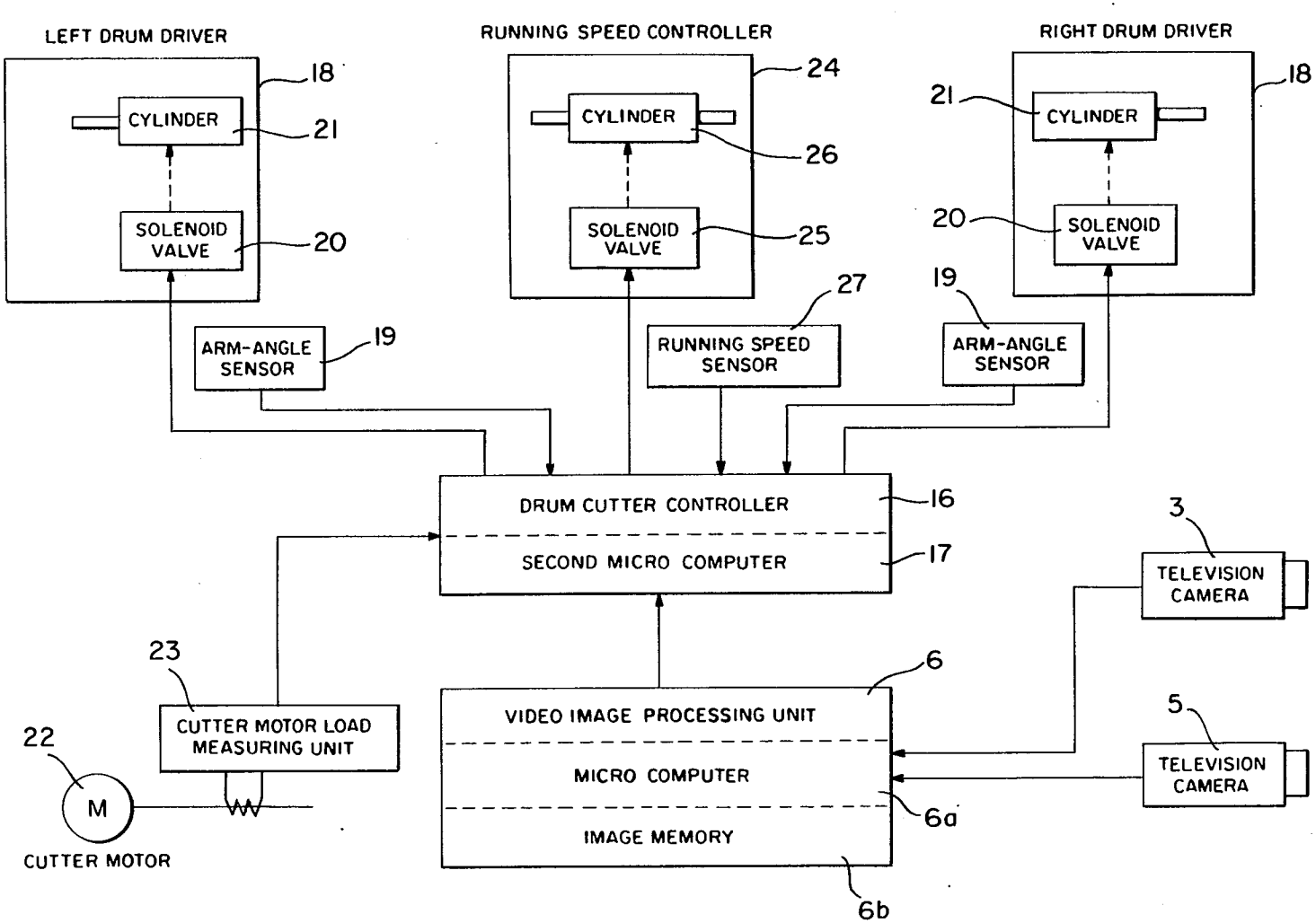
FIG. 3 is a block diagram of the control system used by the applicant.

In the control circuit shown in FIG. 3, a video signal from television cameras 3, 5 is fed to a video image processing unit 6. A microcomputer **6*a* in the unit 6 binalizes the video signal into either "1" or "0" according to the color. The binalized signal is stored in an image memory 6*b***.

Video signals from the television cameras 3 and 5 have an analog voltage value as continuous quantity at every point in the field of vision. The video image processing unit 6 converts the video signals into digital quantity which can be handled by a computer. In this analog-to-digital conversion, the display 13 televised by the television camera is divided, for instance, into 508 divisions in the horizontal direction and into 240 divisions in the vertical direction, i.e., a total of 508×240 divisions, for sampling. The sampled divisions (i.e., minimum units) are called pixels.

The brightness level of each pixel can be expressed through conversion of the analog voltage value into the digital quantity.

Where the analog voltage level is compared to a threshold brightness level, with which the bedrock image 11A is discriminated from the coal layer image 7A (see FIG. 2), the brightness level can be expressed as "1" when it is above the threshold and "0" when it is below the threshold. Thus, the display 13 televised by the television camera can be expressed as a binary signal, which can assume two values of "1" and "0", for each pixel.

A drum cutter controller 16 receives "1" and "0" of the binalized signal stored in the image memory **6*b*, and a second microcomputer 17 computes the area ratio between the coal layer and rock by counting "1" signals. A control signal is fed to drum drivers 18 for control of the drum height such as to reduce the proportion of the area occupied by rock while supervising data from arm angle sensors 19**.

In the drum drivers 18 receiving the control signal, a solenoid valve 20 for controlling the oil hydraulic circuit is operated. The oil hydraulic circuit operated a cylinder 21, so that the drum height is controlled by the cylinder 21.

Further, the control circuit shown in FIG. 3 includes a cutter motor load measuring unit 23 for detecting the cutter motor load from the power supply to a cutter motor 22, a running speed sensor 27 for detecting the running speed, a running speed contoller 24 for controlling the running speed and a solenoid valve 25 and a cylinder 26 constituting the running speed controller 24. It is thus possible to obtain the control in combination with the cutter motor load and the running speed according to a program of a drum cutter controller 16.

In accordance with the inventive concept, coal and rock are cut together. However, coal and rock can be readily separated from the mixture in a coal selection step after the cutting.

Figure 4A:
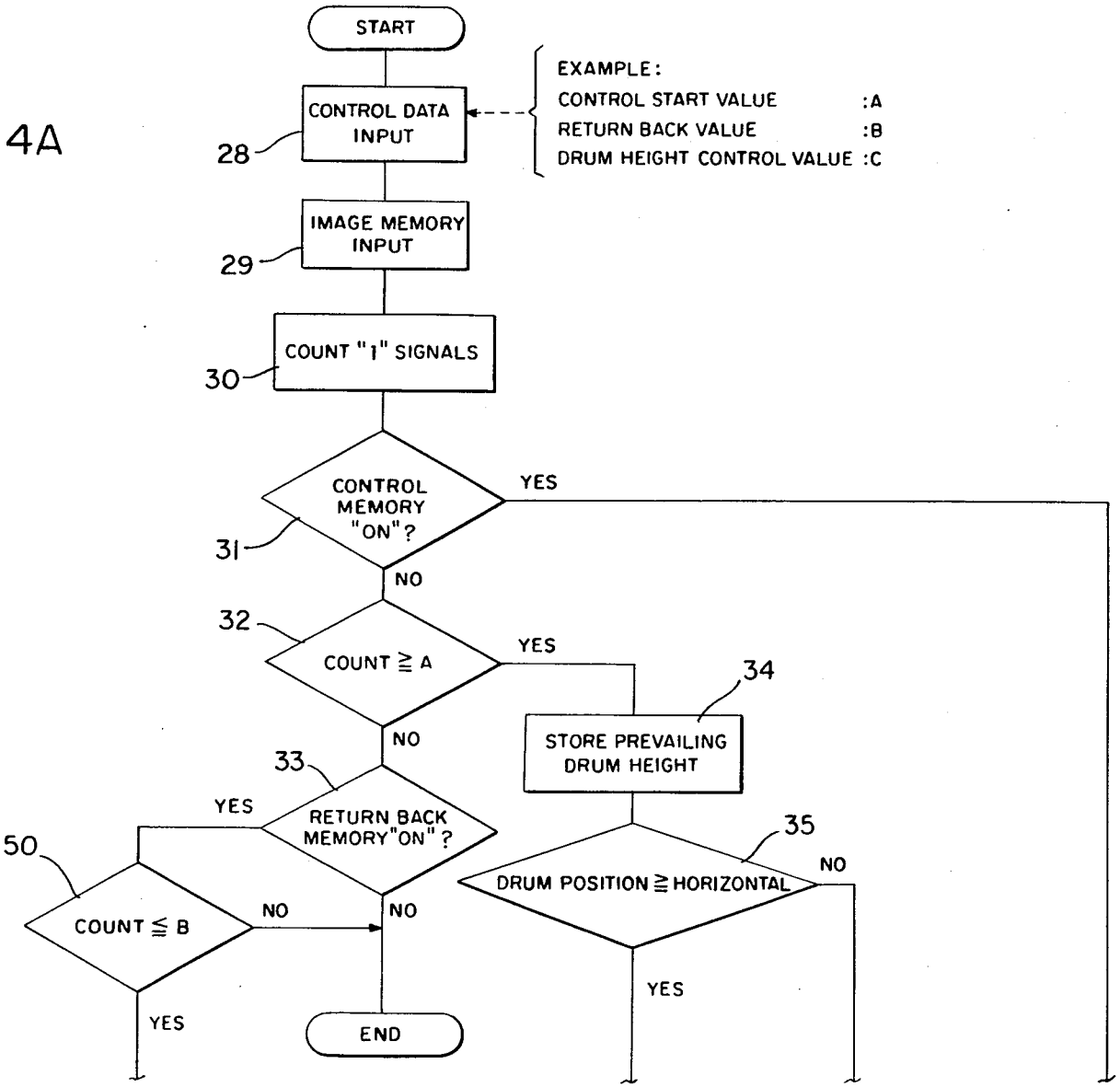
Figure 4B:
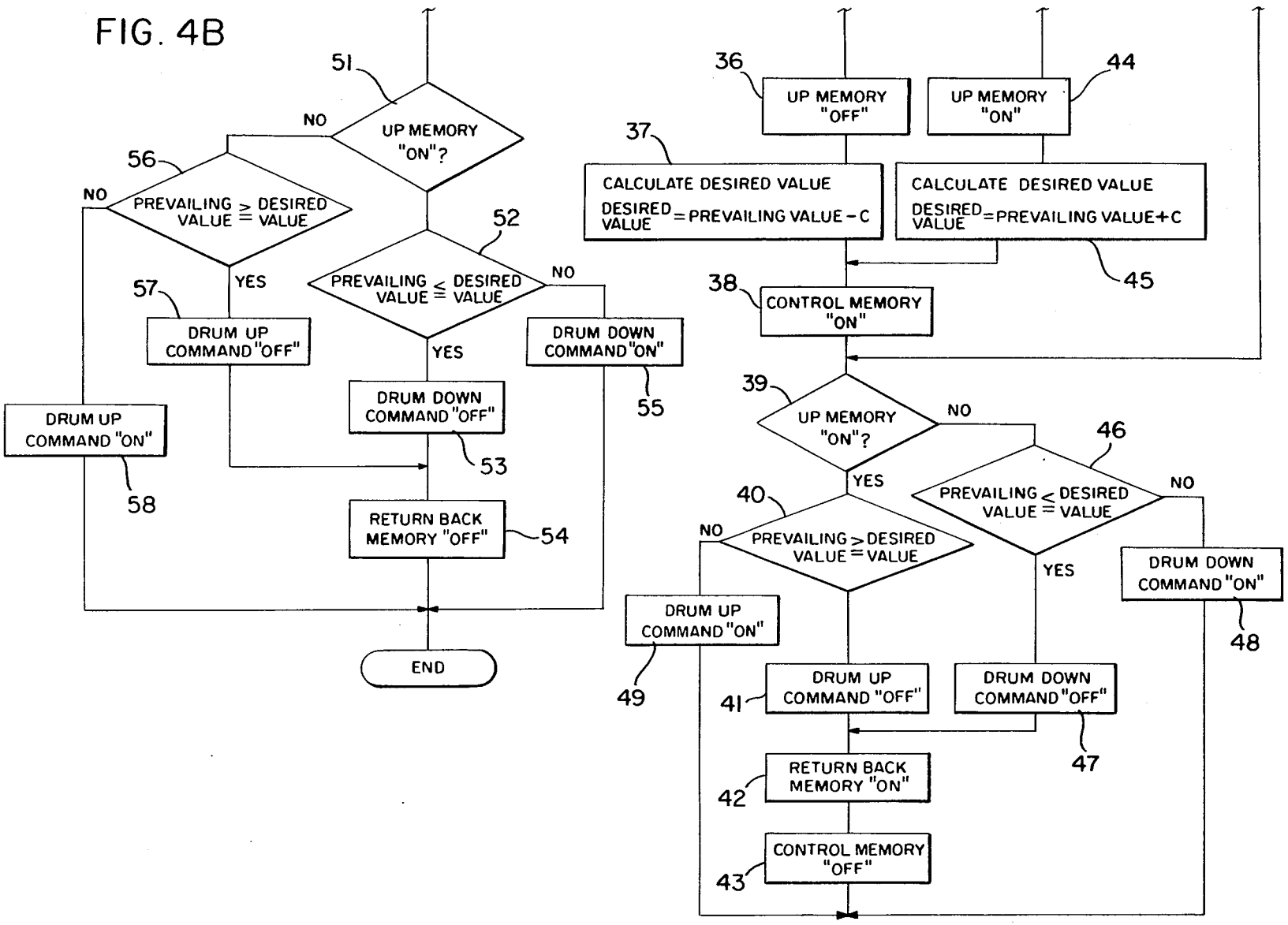

FIGS. 4A and 4B show a control flow chart of the control circuit shown in FIG. 3. The initial value (%) of control is denoted by A, the return back value (%) by B, the drum height control value (i.e. operational width in millimeters for control) by C and the following signals or operations take place in the unit shown in FIGS. 4A and 4B which can be obtained commercially from commercially available components:

start switch **6*b***
control input data 28
image memory input 29
count "1" signal 30
control memory ON 31
count 32
return back memory ON 33
store prevailing drum height 34
drum position equal to or greater than horizontal 35
up memory OFF 36
calculate desired value 37
control memory ON 38
up memory ON 39
prevailing value 40
drum up command OFF 41
return back memory ON 42
control memory OFF 43
up memory ON 44 calculate desired value 45
prevailing desired value 46
drum down command OFF 47
drum down command ON 48
drum up command ON 49
count 50
up memory 51
prevailing desired value 52
drum down command OFF 53
return back memory OFF 54
drum down command ON 55
prevailing desired value 56
drum up command OFF 57
drum down command 58

The operations are as follows:

I. Normal control
START → 28 → 29 → 30 → 31 → 32 → 33 → END II. Lowering the drum when the proportion of area occupied by upper bedrock rock is large
START → 28 → 29 → 30 → 31 → 32 → 34 → 35 → 36 → 37 → 38 → 39 → 46 → 48 → END III. Reducing the drum height to the desired value
START → 28 → 29 → 30 → 31 → 39 → 46 → 47 → 42 → 43 → END IV. Maintaining the prevailing state when the subsequent rock area proportion is greater than the return back value
START → 28 → 29 → 30 → 31 → 32 → 33 → 50 → END V. Returning the drum height to the value before the control when the rock area proportion becomes less than the return back value
START → 28 → 29 → 30 → 31 → 32 → 33 → 50 → 51 → 56 → 58 → END VI. Returning to the control I when the initial drum height is recovered
START → 28 → 29 → 30 → 31 → 32 → 33 → 50 → 51 → 56 → 57 → 54 → END VII. Raising the drum when the proportion of area occupied by lower bedrock rock is large
START → 28 → 29 → 30 → 31 → 32 → 34 → 35 → 44 → 45 → 38 → 39 → 40 → 49 → END VIII. Raising the drum height to the desired value
START → 28 → 29 → 30 → 31 → 39 → 40 → 41 → 42 → 43 → END IX. Maintaining the prevailing state when the subsequent rock area proportion is greater than the return back value
START → 28 → 29 → 30 → 31 → 32 → 33 → 50 → END X. Returning the drum height to the value before the control when the rock area proportion becomes less than the return back value
START → 28 → 29 → 30 → 31 → 32 → 33 → 50 → 51 → 52 → 55 → END XI. Returning to the control I when the initial drum height is recovered
START → 28 → 29 → 30 → 31 → 32 → 33 → 50 → 51 → 52 → 53 → 54 → END As hereinbefore described, the video image processing unit has a microcomputer which changes into a binary code the video signals from the television cameras 3 and 5 according to the color difference to data "1" (usually white) and "0" (usually black) and stores the data in an a image memory **6*b*. The data "1" corresponds to the images 11A and 12A of the bedrock while the data "0" corresponds to the image 7A of the coal layer as shown in FIG. 2**.

The binary data "1" and "0" stored in the image memorry **6*b* are fed to a drum cutter controller 16. A second microcomputer 17 provided in the controller counts "1" signals and thereby calculates the area ratio between the coal layer and bedrock. The controller controls the drum drivers 18** to control the vertical positions of the cutter drum according to the calculated area ratio such that the ratio of the area of the bedrock to the area of the coal layer in the portion of the bedrock being cut is made to smaller value.

Mine dust that is produced when coal is extracted by the cutter drum is highly permeable to infrared rays. Therefore, it is possible to improve the image pick-up performance by projecting infrared rays from the infrared ray projector to the image pick-up sections so of the television cameras and using infrared ray television cameras which are not ITV but have superior sensitivity to infrared rays.

Figure 6:
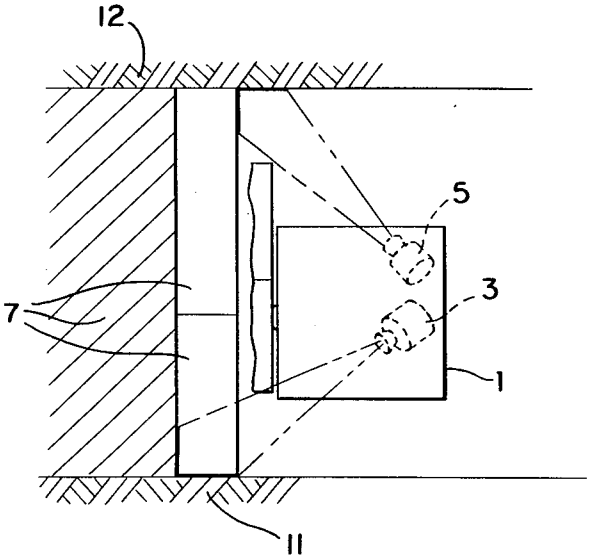
FIG. 6 is a schematic back view of FIG. 1 showing the interrelationship of the components.
Figure 5:
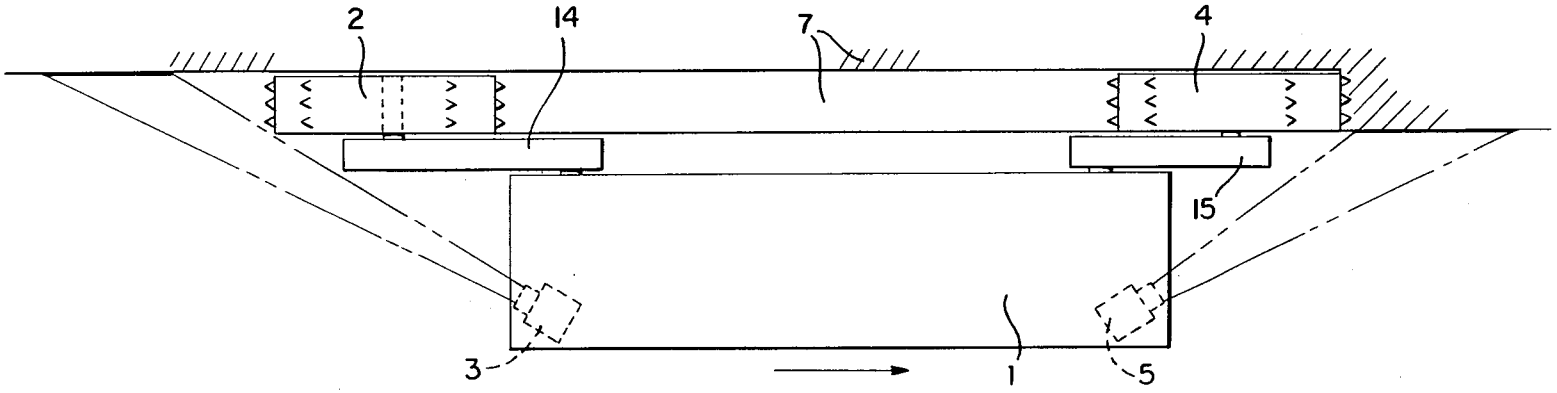
FIG. 5 is a plan view of FIG. 1.

It is to be observed that as explained in the drawing, particularly in FIGS. 5 and 6, FIG. 5 is a plan view of FIG. 1, and FIG. 6 is a schematic back view (viewed from the left side of FIG. 5) showing the relation between the television cameras 3 and 5 and portions televised by these television cameras 3 and 5. The television camera 5 can televise the top of the coal layer 7 and the bottom of the upper bedrock 12 on the side of the coal layer 7. The television camera 3 can televise the lower part of the coal layer 7 and the top of the lower bedrock 11 on the side of the coal layer 7.

What is claimed is:

1. A double ranging drum cutter of the long wall type machine for the extraction of coal which is designed to move longitudinally on a face conveyor set on a bed of rock and coal, the front of the face conveyor also extending along the coal layer, in combination:

(a) an elongated carrier body (1) with a defined front and rear, said front being in the direction of movement of said carrier body when in a cutting mode of operation, said carrier body being adapted and designed to move along the face conveyor;

(b) a rear cutter drum assembly including a rear support arm (14) attached to the carrier body, said rear assembly including a first drum driver on said support arm, also a rear vertically rotating cutter drum (2) supported by said rear support arm;

(c) a front cutter drum assembly including a forward support arm (15) with a transversal shaft disposed on the front side of the carrier body (1), said front assembly including a second drum driver located on said support arm, also, a forward vertically rotating cutter drum (4), supported by said forward support arm;

(d) front and rear infrared television cameras (3,5) and assemblies for picking up an image of a portion of the lower and upper bed of rock and coal being cut by the front and rear cutter drums, each assembly including an infrared ray projector (9, 10) for projecting infrared rays onto the the surface being cut so that said surface in turn can be viewed by said cameras (3,5), and, (e) a video image processing unit (6) mounted on the carrier body (1) and electrically connected to the front and rear television cameras (3, 5) including a first microcomputer (**6*a*) to transform the received video signals into a binary code unit, a memory (6*b*) to store the signals, a drum cutter control (16) mounted on the carriage body, coupled to each cutter drum driver (18), a second microcomputer (17) for counting said binary code units and causes the controller (16**) to control the action of the cutter drums.

* * * * *